United States Patent [19]

Palmer

[11] 4,150,498

[45] Apr. 24, 1979

[54] FOOT COVER AND BLANK THEREFOR

[75] Inventor: Alfred M. Palmer, Independence, La.

[73] Assignee: Peds Products, Inc., Riverside, Calif.

[21] Appl. No.: 855,203

[22] Filed: Nov. 28, 1977

[51] Int. Cl.[2] ..... A43B 3/10; A43B 19/00

[52] U.S. Cl. ..... 36/10; 2/61; 2/239

[58] Field of Search ..... 36/10, 9 R, 9 A; 2/61, 2/239

[56] References Cited

U.S. PATENT DOCUMENTS

| | | | |
|---|---|---|---|
| 2,305,926 | 12/1942 | Kohler | 2/61 UX |
| 2,376,399 | 5/1945 | Yandell | 36/10 |
| 2,724,195 | 11/1955 | Luchs | 36/10 |
| 2,764,823 | 10/1956 | Struble et al. | 36/9 R |
| 3,457,566 | 7/1969 | Artzt | 2/239 |

FOREIGN PATENT DOCUMENTS

| | | | |
|---|---|---|---|
| 74211 | 3/1918 | Austria | 2/239 |
| 85382 | 6/1920 | Switzerland | 2/239 |
| 155747 | 12/1920 | United Kingdom | 36/9 A |

*Primary Examiner*—James Kee Chi

*Attorney, Agent, or Firm*—Bell, Seltzer, Park & Gibson

[57] ABSTRACT

The foot cover is formed of a substantially Y-shaped one-piece blank of stretchable material. The main stem of the Y-shaped blank forms an elongate sole portion including heel and toe ends while the branches or wings of the Y-shaped blank extend outwardly therefrom and define toe, side and heel portions which form the upper portion of the foot cover. The blank is formed into the foot cover by one relatively long seam which extends continuously from one side to the other of the sole portion and connects the lower edges of the side and heel portions thereto and a relatively short seam which connects opposite ends of the side and heel portions and extends upwardly from the relatively long seam to the foot receiving opening.

4 Claims, 6 Drawing Figures

FOOT COVER AND BLANK THEREFOR

This invention relates generally to a foot cover and blank therefor and more particularly to a "low cut" type of foot cover in which the upper portion extends to a position below the ankle with the upper edge being substantially contiguous with the upper edge of the shoe.

Various types of low cut or within-the-shoe foot covers have been formed of one-piece blanks. For example, Luchs U.S. Pat. No. 2,628,438 discloses this type of foot cover formed with a first pair of seams positioned adjacent opposite sides of the heel and a second pair of seams positioned adjacent opposite sides of the toe. Luchs U.S. Pat. No. 2,724,195 discloses this type of foot cover with a first pair of seams extending along opposite sides of the sole and with a second pair of seams extending upwardly from the sole seams and at opposite sides of the sock. Abel U.S. Pat. No. 3,289,328 discloses this type of foot cover with a long seam extending beneath the toes, along one side of the sole and beneath the heel with a short seam extending upwardly and at one side of the foot cover. While the foot covers disclosed in these patents are formed of one-piece blanks, the positions of certain of the seams can cause discomfort to the wearer.

Accordingly, it is an object of the present invention to provide an improved foot cover formed of a one-piece blank and in which the seams are positioned so that they will not cause discomfort to the wearer.

In accordance with the present invention, the foot cover is formed of a substantially Y-shaped one-piece blank of stretchable material with the main stem of the Y-shaped blank providing an elongate sole portion including heel and toe ends and with the outwardly extending branches of the blank providing the upper portion of the foot cover. A relatively long seam extends continuously around the sole portion from one side to the other of the toe end and connects the upper portion thereto. A relatively short seam connects opposite ends of the upper portion and extends upwardly in the middle of the heel and from the sole seam to the foot receiving opening. The foot cover blank is preferably cut from stretchable knit fabric which may be of a lightweight sheer construction so that the foot cover may be worn with dress shoes or the knit fabric may be of a heavier construction and may include terry loops so that the foot cover can be worn as a sport sock inside of tennis shoes or the like. The foot receiving opening defining the upper edge of the foot cover is provided with an overedge seam and an elastic tape or band is attached to the foot receiving opening by the overedge seam.

Other objects and advantages will appear as the description proceeds when taken in connection with the accompanying drawings, in which FIG. 1 is a plan view of the one-piece blank used in forming the foot cover in accordance with the present invention;

Figure 1:
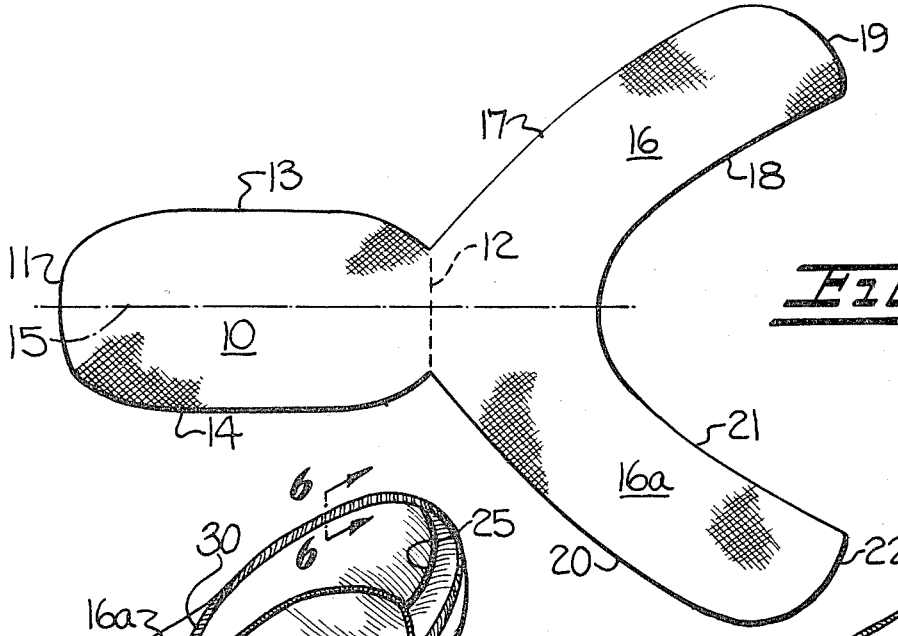
Figure 2:
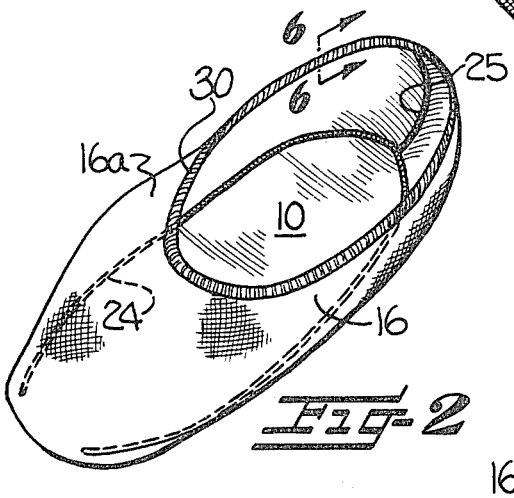
FIG. 2 is an isometric view looking downwardly at the upper portion of the foot cover.
Figure 3:
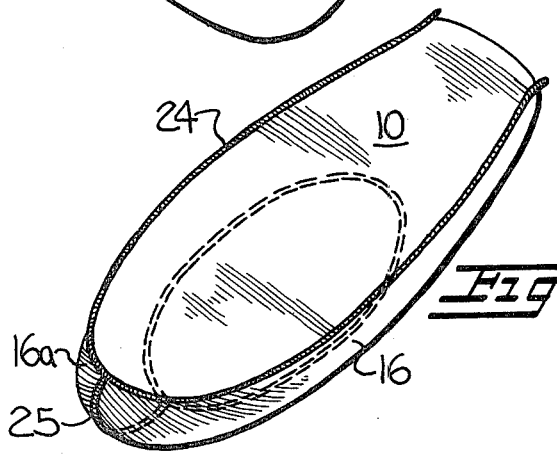
FIG. 3 is an isometric view looking upwardly at the sole portion of the foot cover, the foot cover being turned inside out.
Figure 4:
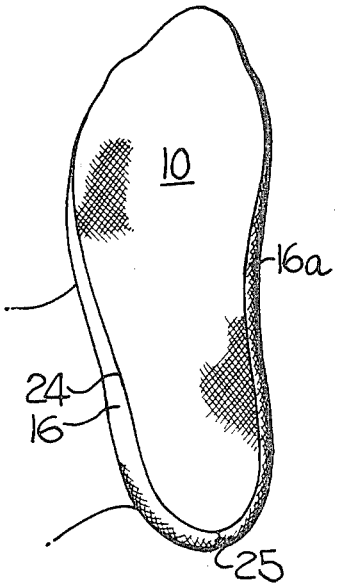
FIG. 4 is a perspective view looking at the bottom of the foot cover and illustrating its appearance when placed on the foot.
Figure 5:
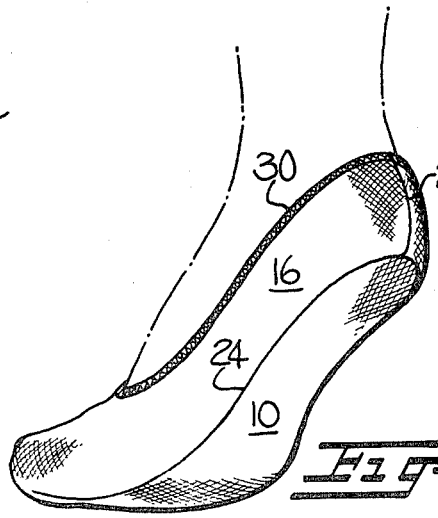
FIG. 5 is a perspective view of the foot cover, looking from the rear and illustrating its appearance when worn on the foot.

As illustrated in FIG. 1, the substantially Y-shaped one-piece blank for forming the stretchable foot cover includes a main stem defining an elongate sole portion, broadly indicated at 10. The sole portion 10 includes a curved heel end 11 and a toe end, indicated by the dotted fold line 12. Opposite sides 13, 14 of the sole portion 10 are equally spaced from and extend generally parallel to the longitudinal center line, indicated by dash-dot line 15, of the sole portion 10 and the opposite sides 13, 14 are slightly curved outwardly.

The outwardly and upwardly extending branches of the Y-shaped blank provide a pair of wing portions 16, **16*a*, each defining toe, side and heel portions integral at their inner ends with the toe end of the sole portion 10 and integral with each other along the extension of the longitudinal axis 15 of the sole portion 10. The wing portion 16 includes generally parallel outwardly curved first and second or lower and upper sides 17, 18 and an outer free end 19. The wing portion 16*a* also includes generally parallel outwardly curved first and second or lower and upper sides 20, 21 and an outer free end 22**.

The dimensions of the substantially Y-shaped blank shown in FIG. 1 will vary in accordance with the size of the foot cover desired and the type of stretchable textile fabric from which the blank is cut. It is preferred that the first or lower sides 17, 20 of the respective wing portions 16, **16*a* be of substantially the same length as the sum of the length of one of the corresponding sides 13, 14 and one-half of the length of the heel end 11 of the sole portion 10**. For example, when the knit fabric is constructed of relatively fine denier or sheer yarn which has a highly stretchable characteristic, it will be necessary to form only one or two sizes to fit the full range of foot sizes. On the other hand, when the knit fabric is constructed of relatively heavyweight yarn having a relatively low degree of stretch, either with or without terry loops, it may be necessary to form more than two sizes of blanks so that the foot cover will fit the full range of foot sizes.

Figure 6:
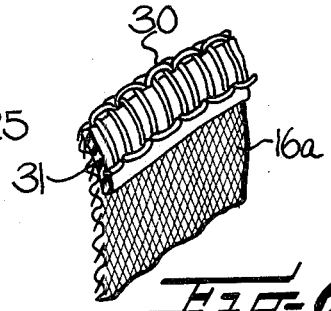
FIG. 6 is an isometric fragmentary sectional view taken substantially along the line 6—6 in FIG. 2 and illustrating the manner in which the elastic tape or band is attached to the foot receiving opening by the overedge seam.

To form the foot cover from the blank shown in FIG. 1, the toe portion is folded along the dotted line 12 and first seam means, indicated by the seam 24, is continuously formed completely around the sole portion 10 and from one side to the other of the toe end to connect the first or inner sides 17, 20 of the wing portions 16, **16*a* to the sole portion 10. Second seam means, indicated by seam 25, connects the adjacent outer ends 19, 22 of the side and heel portions 16, 16*a* and extends upwardly from the seam 24 to the foot receiving opening defined by the second sides 18, 21 of the side and heel portions 16, 16*a*. Overedge seam means, indicated as an overedge seam 30 (FIG. 6), is formed around the foot receiving opening and an elastic tape or band 31 is attached to the inner surface of the foot receiving opening by the overedge seam 30**.

The order in which the seams 24, 25 and 30 are formed is not critical. However, it has been found desirable to first form the overedge seam 30 while attaching the elastic tape or band 31 to the foot receiving opening. The outer ends 19, 22 are then connected together by forming the seam 25, and then the upper portion of the foot cover is connected to the sole 10 by forming the seam 24, starting at one side of the toe end of the sole portion 10 and sewing continuously and completely around the sole portion.

The foot cover of the present invention thus includes first seam means, seam 24, extending around the sole of the foot of the wearer where the pressure between the shoe and the foot is at a minimum and second seam means, seam 25, connecting adjacent ends 19, 22 of the side and heel portions 16, 16*a* and extending a relatively short distance upwardly from the seam 24 and to the foot receiving opening at the middle of the heel. It will be noted that there are no seams extending across the ends of the toes or above or beneath the toes and no seams extending vertically on either side of the foot cover so that the foot cover can be worn on either foot.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A foot cover formed of a one-piece blank of stretchable material and comprising (a) an elongate sole portion symmetrical about a longitudinal center line and including opposite side edges, and heel and toe ends at opposite ends thereof, said heel end being curved and joining said opposite side edges, (b) an upper portion including a medial toe covering portion integral with and extending upwardly from said toe end of said sole portion, and elongate side and heel portions including inner ends integral with and extending rearwardly from said toe covering portion, said elongate side and heel portions including first side edges adjacent said opposite side edges of said sole portion and second side edges spaced above said first side edges and defining a foot receiving opening, said elongate side and heel portions including outer ends extending upwardly in adjacent relationship from the middle of said heel end of said sole portion, (c) first seam means connecting said first side edges of said side and heel portions to said opposite side edges of said sole portion and said heel end thereof, and (d) second seam means connecting said adjacent outer ends of said side and heel portions and extending upwardly from said first seam means to the foot receiving opening defined by said second side edges of said elongate side and heel portions.

2. A foot cover according to claim 1 wherein said stretchable material is knit fabric.

3. A foot cover according to claim 1 including overedge seam means extending around said second side edges defining said foot receiving opening, and an elastic tape attached to said overedge seam means.

4. A one-piece blank for forming a stretchable foot cover comprising (a) an elongate sole portion symmetrical about a longitudinal center line and including opposite side edges, and heel and toe ends at opposite ends thereof, said heel end being curved and joining said opposite side edges to define a free end of said blank, and (b) a pair of wing portions, each defining toe, side and heel portions integral with said toe end of said sole portion and each wing portion including generally parallel outwardly curved first and second side edges and inner and outer ends, the inner ends of said wing portions being integral with each other and extending outwardly of and along the center line of said sole portion, and the length of said first side edges of each of said wing portions being substantially the same as the sum of the length of one side edge of the sole portion and one-half of the length of heel end of said sole portion.

* * * * *